United States Patent [19]

Chen

[11] 4,391,265

[45] Jul. 5, 1983

[54] KEY-(TOUCH-) CONTROLLED GAS RANGE

[76] Inventor: Si-Yu Chen, 37 Kueiyang St. Sec. 1, Taipei, Taiwan

[21] Appl. No.: 228,181

[22] Filed: Jan. 26, 1981

[51] Int. Cl.[3] ..... F24C 3/00

[52] U.S. Cl. ..... 126/39 E; 126/52; 251/207

[58] Field of Search ..... 126/52, 1 R, 39 R, 39 E, 126/238, 234; 251/207

[56] References Cited

U.S. PATENT DOCUMENTS

| | | | |
|---|---|---|---|
| 1,190,656 | 7/1916 | Kennedy | 126/52 |
| 1,445,984 | 2/1923 | Wilkinson | 126/39 E |
| 2,234,550 | 3/1941 | Bridgeman | 126/52 |
| 2,286,766 | 6/1942 | Sherman | 126/39 R |
| 2,621,012 | 12/1952 | Graham | 251/207 |
| 3,115,896 | 12/1963 | Roberts | 251/207 |
| 3,132,428 | 5/1964 | Haissig et al. | 251/207 |
| 3,312,397 | 4/1967 | Willson | 126/39 E |
| 3,405,869 | 10/1968 | Grayson et al. | 126/39 E |
| 3,476,315 | 11/1969 | Biggle | 126/39 E |
| 3,558,100 | 1/1971 | Hulsey | 251/207 |

*Primary Examiner*—Daniel J. O'Connor

[57] ABSTRACT

A key-(touch-) controlled gas range is provided, which consists of touch-controlled flame adjusting means, continuous ignition circuit, burner and valve with multiple channels, so that the flame intensity may be adjusted automatically in a key-controlled manner. A set of memory means is also provided therein so that the flame intensity is instantly changed to a small intensity of the live fire whenever the pot is removed and the flame intensity is automatically returned to the original intensity after the pot is put back thereon.

3 Claims, 16 Drawing Figures

KEY-(TOUCH-) CONTROLLED GAS RANGE

BACKGROUND OF THE INVENTION

1. Field of the Invention

This invention relates to gas ranges and in particular to key-controlled (touch-controlled) gas ranges. The present range offers touch switch means capable of adjusting burner flame intensities automatically through the use of multi-channeled valves and key or switch means capable of operating a continuous ignition circuit. The present range also has memory means which adjusts burner flame intensity in response to the placing of or removing of a pot from a burner. Removal of a pot lowers the flame intensity. Replacement of the pot acts to readjust the flame intensity to that which it was prior to the removal step. The range touch-switch means also enables the user to obtain a minimal base fire or to obtain a specific flame intensity simply by the pressing down of a selected control switch or key. Thus, a burner flame may be ignited at low intensity on the present range rather than at high intensity as is typically done in known gas ranges. The control keys of the present invention may be located at an appropriate place (such as the work counter or the table of a restaurant), by means of connecting wires. The control keys enable the user of the range to adjust the flame intensity automatically rather than having to bend down and visually adjust the flame. The flame on the present range may be completely extinguished by pressing down a proper control key.

2. Description of the Prior Art

Although conventional gas ranges with electronic ignitions are available, such ranges carry many disadvantages. For example, when a user is desirous of lighting a flame under a burner in a conventional gas range, the flame intensity control knob must be turned to high to release sufficient gas to enable the sparks from the electronic ignition head to ignite a flame. In view of the fact that the intensity control knob is at high, the resulting flame will also be of a high intensity. If the above-mentioned operation fails, the intensity control knob must be turned off and the operation repeated. Therefore, gas is wasted. Moreover, although the desired flame may be finally ignited, it will be a high intensity flame therefore necessitating its readjustment by means of the intensity control knob. Thus, not only is gas wasted but the time required to operate the range is increased. Additionally, in such ranges, the intensity control knob is combined with the gas tube valve and therefore, must be connected thereto. In conventional gas ranges adjustment of the burner flame intensity involves a person moving to one side of the gas range, bending down, staring at the fire, and manually and slowly turning the intensity control knob to obtain the desired flame intensity. A sudden or unsteady turning motion of the intensity control knob may cause the flame to be extinguished. Thus, the desired flame intensity cannot be obtained rapidly.

During cooking many housewives remove pots placed on the burners without adjusting the burner flame. The flame is therefore left burning which is a waste of gas. There are gas ranges available in which the burner flame is automatically lowered when a pot is removed therefrom, the burner flame being automatically returned to its original intensity when the pot is returned. However, such ranges are complex in structure, may be easily damaged through exposure to cookings oils, and are not readily serviceable.

SUMMARY OF THE INVENTION

In view of the aforementioned disadvantages of conventional gas ranges, this invention provides a gas range which can be operated easily and does not waste gas.

The main object of this invention is to provide a touch-switch controlled gas range having a plurality of switches which are representative of varying flame intensities (i.e., very mild heat, mild heat, moderate heat, strong heat, hot heat, very hot heat, and off). A particular flame intensity may be selected by pressing down the appropriate switch. The power will then be activated and the electronic ignition means will begin to operate. Once a base fire is ignited, a sensor will automatically stop the operation of the ignition device. The base fire is then used to ignite a flame with an intensity corresponding to the pressed key.

Another object of this invention is to provide a touch switch controlled gas range wherein a multi-channeled valve directly controls the gas flow. This valve has a housing and a central rotatable part. The central rotatable part is a rotor which defines a number of channels. The number of channels correspond to the number of keys. The channels are in communication with each other at the center of the rotor. Their size corresponds with the flame intensities which they represent. Three ports are provided on the valve housing two of which are located opposite of each other and on the sides of the valve. The diameters of the two opposing ports are the same as the width of the largest channel defined within the rotor. One of the opposing ports is the gas inlet port and is connected to the gas source. The other opposing port is the gas outlet port and is connected to the burner. The third port extends through the housing of the valve to the center of the rotor. The diameter of the third port is the same as that of the gas tube for the base fire and is connected by means of a metal tube is to the base fire nozzle which is adjacent the electronic ignition means at the periphery of the burner. Whenever there is any gas flowing through the channels within the rotor of the valve, a portion of that gas will flow through the metal tube to the base fire nozzle. It may be assumed that when the "off key" is pressed, the rotor is rotated to an angle (such as 0 degrees) that blocks the gas inlet port and the gas outlet port on the housing and thereby cuts off the path of gas flowing to the base fire nozzle and burner. When the base fire key is pressed, the rotor is rotated to another angle (such as 22.5 degrees) thereby bringing the smallest base fire channel into communication with the gas inlet tube and the other portion of the rotor opposite to the base fire channel, sealing the gas outlet port. Therefore, gas flows from the gas inlet port to the base fire nozzle through the base fire channel and the third port, and is there ignited by the electronic ignition means. When one of the other keys is pressed, part of the gas is directed to the burner by the appropriately selected channel and part of the gas is directed to the base fire nozzle through the third port thereby maintaining the base fire or supplying the necessary gas for igniting the base fire. The flame intensity of the burner may be appropriately controlled by means of the varying sized channels defined in the rotor.

A further object of this invention is to provide a touch-switch controlled gas range in which the control circuit is comprised of a power rectifier, an electronic ignition circuit, an operational amplifier, a servo motor, and switch means provided with multiple keys. The keys in the switch means represent different flame intensities. The keys are singly selective. That is, the pressing of one key will cause the release of any other depressed key. Thus, only one key can be depressed at one time. Further, the keys representing the various flame intensities (off-key excluded) are linked to the general power switch and the power switch of the electronic ignition circuit in the manner of a three pole switch. When a particular key is pressed, the general power switch and the electronic ignition circuit are activated causing the ignition head which is located next to the base fire nozzle, to begin discharging. Pressing the key further causes the switch of the operational amplifier to close and thereby produce an output-voltage level commensurate with the resistor to which it is connected in series. This voltage actuates the servo-motor, rotating it to a predetermined angle (0 V). A small portion of gas is then directed from the center of the rotor to the base fire nozzle through the third port and is ignited by the ignition head.

After the base fire is ignited, the electronic ignition circuit automatically stops in a manner known in the art. Simultaneously, gas flows to the burner through the gas outlet of the valve and is ignited by the fire. Both ignition of a fire and of a desired valve intensity are accomplished by pressing a control key down. Moreover, if the base fire has not yet been ignited, the ignition head will continuously discharge sparks until such base fire is ignited. There is no need in the present invention to constantly manipulate the intensity control knob to an off and high position to obtain a base fire. Thus, if the base fire is inadvertently extinguished, the ignition head of the present invention will automatically discharge and reignite the base fire avoiding the risk of leaking gas. If it is desired to change the flame intensity, another key need only be pressed. This pressing action closes the general power switch and the power switch of the electronic ignition circuit. Since the base fire is still lit, the electronic ignition circuit will not operate. As the new key is further pressed down, the previously pressed-down key is released and another resistor is brought into series with the power supply. The operational amplifier then outputs another voltage which rotates the servo-motor to another angle. This rotation causes an alternative gas channel to move into communication with the gas inlet and gas outlet tubes and thus effects the burner flame intensity. Since the gas tube for the base fire is at the center of the rotor, the gas flowing to the base fire nozzle is not affected by the rotation of the rotor. When it is desired to extinguish the fire, the off-key need only be pressed. The other keys will then be released, the power supply will be cut off, and the servo-motor will be actuated to return to its original (0 degree) position. Thus, the gas path will be cut off and the fire at the burner and the base fire will be simultaneously extinguished.

A further object of this invention is to provide a key controlled gas range in which one of the grates is connected to a double pole switch which can be moved downwardly under pressure. A pole S81 of the double pole switch S8 connects the output of the operational amplifier circuit and the input of the servo-motor. Pole S82 disconnects the input voltage of the operational amplifier circuit and the input of the servo-motor. When there is no pressure affecting the double pole switch, the switch will return to its original raised position by means of a spring biasing force. In returning to its original position, switch S81 will be opened and switch S82 will be closed. The spring force necessary to bias the switch need not be large. It must only be great enough to support the grate. The spring force should be enough to overcome about 10 to 20 grams of weight. The opening of S81 and closing of S82 acts to connect the input voltage of the operational amplifier to the input of the servo motor. Therefore, the output voltage of the operational amplifier and circuit cannot be transmitted to the servo-motor. The input voltage of the operational amplifier circuit is the voltage which drives the rotor of the servo-motor to varying angles. When there is no pot on the range, only the base fire can burn. This is true even if a control key for a particular flame intensity has been pressed. When a pot is placed on the range, the weight of the pot presses down the grate causing key S81 to close and key S82 to open thereby connecting the input of the servo motor with the output of the operational amplifier, the operational amplifier acting to rotate the servo-motor to various angles. Thus, various flame intensities are produced in the above-described manner. When the pot is removed from the range, the double pole switch returns to its upper position so that the servo-motor is connected only with the power which means that the rotor can only be rotated to the base fire channel position. When only the base fire is burning and there are no pots on the range, pressing the various intensity control keys will not result in a higher intensity flame. However, when a pot is placed on the range, the output of the operational amplifier will be connected with the input of the servo-motor and cause it to rotate back to its original position. That position is attained through the output voltage of the operational amplifier circuit. The original flame intensity is then reproduced.

The present invention is simple to construct, easy to service, responsive, and accurate.

BRIEF DESCRIPTION OF THE DRAWINGS

The invention will now be further described with reference to the following figures.

FIG. 2(*b*) is a sectional view in elevation of the valve according to the present invention.

FIG. 2(*c*) is a sectional perspective view of the valve in accordance with the present invention.

FIG. 2(*d*) is a sectional top view of the valve in accordance with the present invention showing the rotation angle of the rotor at 0 degrees.

FIG. 2(*e*) is a sectional elevation view of the valve in FIG. 2(*d*).

FIG. 2(*f*) is a sectional top view of the valve of the present invention showing the rotation angle of the rotor at 22.5 degrees.

FIG. 2(*g*) is a sectional elevation view of the valve in FIG. 2(*f*).

FIG. 2(*h*) is a sectional top view of the valve of the present invention showing the rotation angle of the rotor at 45 degrees.

FIG. 2(*i*) is a sectional top view of the valve of the present invention showing the rotation angle of the rotor at 67.5 degrees.

FIG. 2(*j*) is a sectional top view of the valve of the present invention showing the rotation angle of the rotor at 90 degrees.

FIG. 2(*k*) is a sectional top view of the valve of the present invention showing the rotation angle of the rotor at 112.5 degrees.

FIG. 2(*l*) is a sectional top view of the valve of the present invention showing the rotation angle of the rotor at 135 degrees.

FIG. 2(*m*) is a sectional top view of the valve of the present invention showing the rotation angle of the rotor at 157.5 degrees.

FIG. 2(*n*) is a sectional elevation view of the valve in FIG. 2(*m*).

DETAILED DESCRIPTION OF A PREFERRED EMBODIMENT OF THE PRESENT INVENTION

Figure 1:
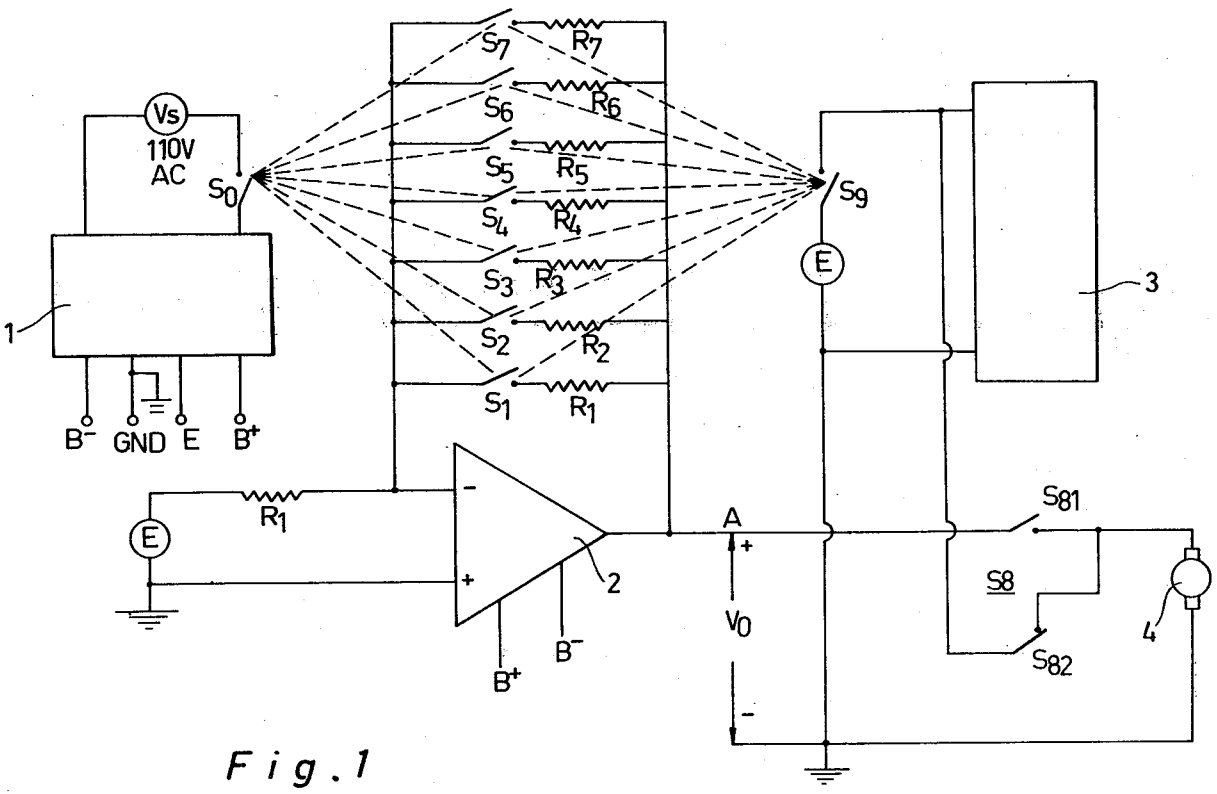
FIG. 1 is an illustrative diagram of the control circuit according to the present invention.

FIG. 1 is an illustrative diagram showing the circuit of one embodiment of the present invention in which the transforming and rectifying means (1) converts 110 AC voltage into DC voltage (B+, B−, E, GND) as the input voltage and power source for the operational amplifier (2). The electronic continuous ignition circuit (3) generates sparks automatically when switch S9 is closed. Its ignition head is adjacent to the base fire nozzle. The ignition circuit is automatically stopped when a base fire has been ignited. The electronic continuous ignition circuit and the automatic ignition stop circuits are well-known electronic devices and therefore, will not be described in detail herein.

The switch having keys S1–S7 is a single selection switch mechanism. The pressing of one key causes the release of any other depressed key. Only one key can be depressed at a time. Keys S1–S7 are individually linked to the general power switch S0 and the power switch S9 of the electronic ignition circuit in the linking relationship of a three pole switch. When a certain key (such as S3 corresponding to a mild heat) of the keys S1–S7 is pressed, the general power switch S0 and the switch S9 of electronic ignition circuit are actuated by a link during the pressing process thereby switching the power supply on and the power for the electronic ignition circuit on. This causes the ignition head to continuously spark next to the base fire nozzle. Key S3 is switched on when the switch is pressed to its lowest position thereby causing the operational amplifier to produce an output voltage V0 at its output end A, which is $V_{03}=(R_3/R_1)E$. In addition, if there is a pot placed on the range during the pressing operation, the key S81 (normally open) of the double pole single throw switch S8 is closed and key S82 (normally closed) is opened by a linking operation. Output voltage $V_{03}=-(R_3/R_1)E$ is then fed as an input voltage to the servo-motor (4) through key S81. The servo-motor 4 will be rotated to an angle (e.g. 67.5 degrees) corresponding to the voltage and thereby driving the rotor of the valve to the channel representing a 67.5 degrees. A portion of the gas flow will then be directed to the base fire nozzle through the base fire gas tube and ignited by the spark of the ignition head. The ignition activity will stop automatically once the base fire has been ignited. Simultaneously, the gas flow corresponding in amount to the rotation angle of the rotor will be directed to the burner and ignited by the base fire thereby producing a flame intensity corresponding to key S3 (mild fire). (The above operation will be described in detail with reference to FIG. 2). If it is desired to change the flame intensity (e.g. to a hotter fire), then key S6 must be pressed down. Since key S3 has not yet been released during the pressing of key S6, keys S0 and S9 are still closed. The power switch is still switched on and the fire on the range is still on mild fire until key S6 is pressed to its lowest position which causes key S3 to be released. As key S6 is also in a linking relationship of a three pole switch with keys S0 and S9, keys S0 and S9 are retained in their closed position. However, the output voltage of the operational amplifier 2 is now changed to $V_{06}=-(R_6/R_1)E$, thus rotating the servo-motor 4 to another angle (135 degrees) thereby driving the rotor to that angle (135 degrees). A differing amount of gas flow is now directed to the burner and the flame intensity is increased. If the pot is boiling over, the valve can be instantly rotated back to a 22.5 degree angle by pressing down key S1. This action causes the main fire to be extinguished and allows only the base fire to burn thereby preventing the pot from boiling over further. The inconvenience of rushing to the range to turn down the fire is eliminated and the likelihood of completely extinguishing the fire by a sudden adjustment is nonexistent. Moreover, if it is desired to change the flame intensity from S6 to a very mild fire, key S2 need only be depressed rather than having to bend down and adjust the flame by sight.

If one of the cooking steps is finished and the pot is removed from the gas range for washing, the double pole single throw switch S8 will immediately return to its normal position (key S81 in an open position, key S82 in a closed position). If the flame intensity of the originally-used fire corresponds to key S5, key S5 will be retained in its pressed-down position and keys S0 and S9 will still be closed. The output voltage V05 of operational amplifier (2) cannot be fed into the servo-motor (4) when the switch S8 is in its normal condition. The servo-motor is therefore, rotated to an angle corresponding to the voltage E fed through key S82. The voltage E may be set as the voltage for the rotor to be rotated with an angle for the base fire (i.e. E=V01) and in this way, only a link is needed to automatically change the fire into a base fire by means of a double pole single throw switch S8. There is no need for the complicated mechanical structure used in conventional "one-touch" gas ranges. In addition, the force needed to press and return switch S8 is very small (e.g. 10–20 grams). Switch S8 may, therefore, be mounted in a corner position of the range box and shielded from cooking contaminants. The conventional "one-touch" gas range controls the flow of the gas in the gas tube directly by the pressure of a pot placed on the burner. Linkage of such ranges requires greater pressure to alter this gas flow. In order to maintain the balance of a pot on the range, the head of such a linkage must be positioned at the center of the range making it susceptible to cooking contaminants and thereby, decreasing its sensitivity over a long period of time. The range switch according to the present invention may be activated by a minimal application of pressure which pressure thereby affects a circuit switch rather than a gas tube. Therefore, the switch may be mounted at a corner of the burner decreasing or eliminating its vulnerability to cooking contaminants. When the pot is put back on the gas range, key S81 of switch S8 is closed and key S82 is opened. While key S5 is still closed, the servo-motor (4) will be rotated with an angle corresponding to the voltage $V_{05} = -(R_5/R_1)E$ and the flame intensity will be returned to what it was prior to removing the pot. Moreover, if it is desired to ignite a fire without the pot on the range, the servo-motor can only be rotated to the angle corresponding to a base fire and the gas will flow only in the base fire gas port. Thus, only a base fire can be ignited despite the depressing of any one of keys S1–S7. In this way, no gas is wasted by the ignition of a high-intensity flame.

Figure 2A:
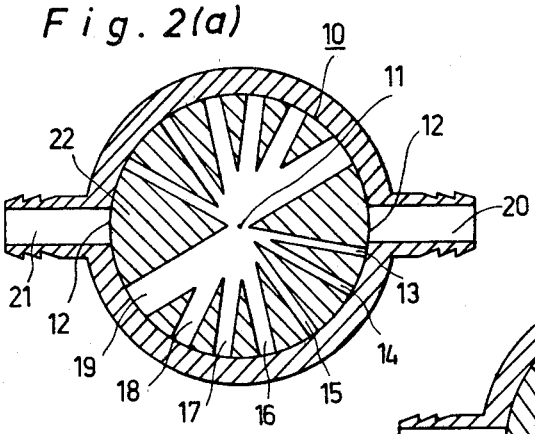
FIG 2(*a*) is a sectional top view of the valve of the present invention.
Figure 2D:
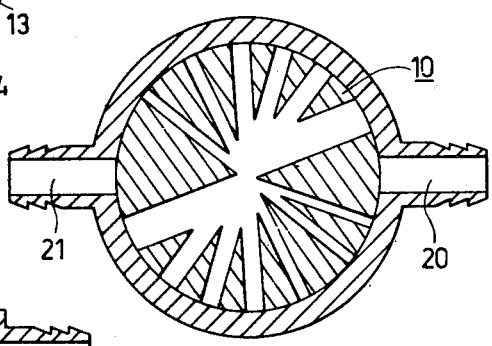
Figure 2B:
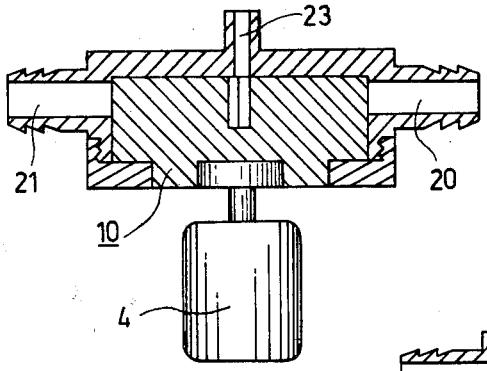
Figure 2E:
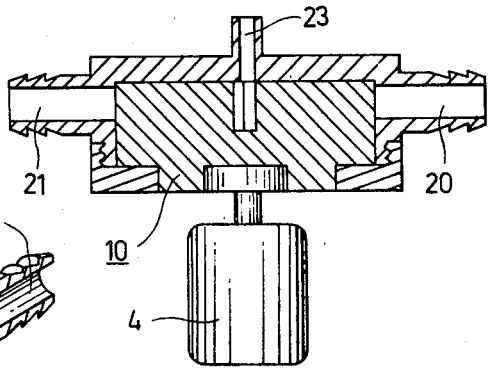
Figure 2C:
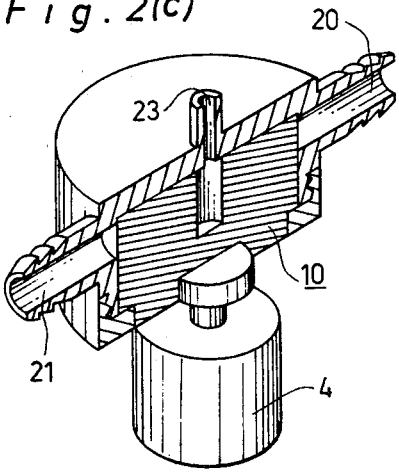
Figure 2F:
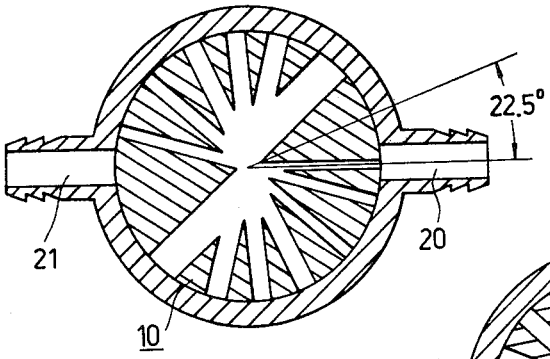
Figure 2I:
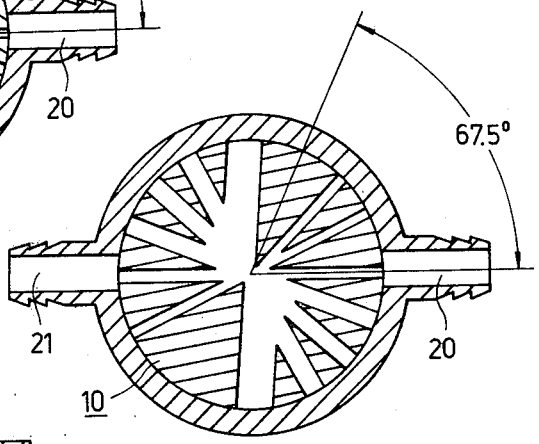
Figure 2G:
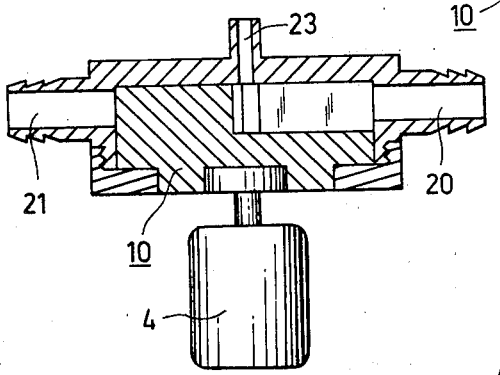
Figure 2J:
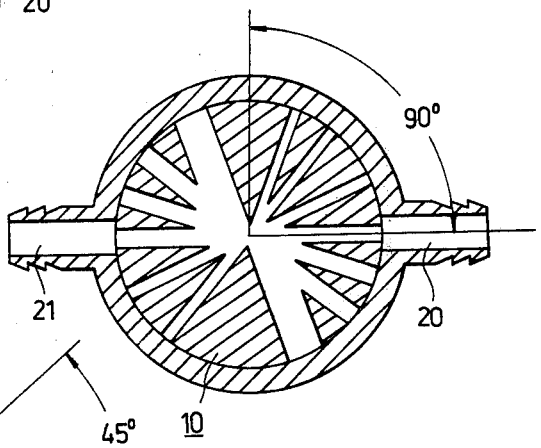
Figure 2H:
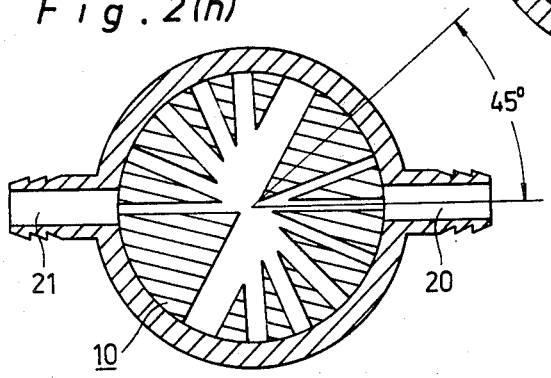
Figure 2K:
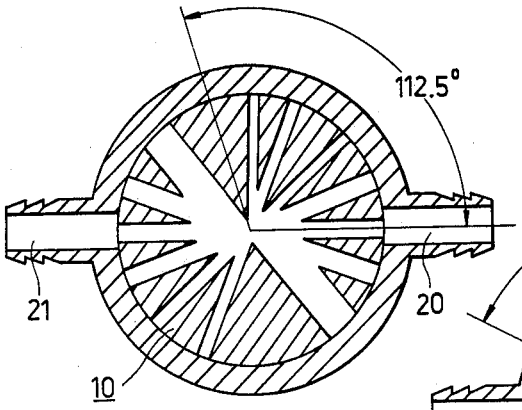
Figure 2M:
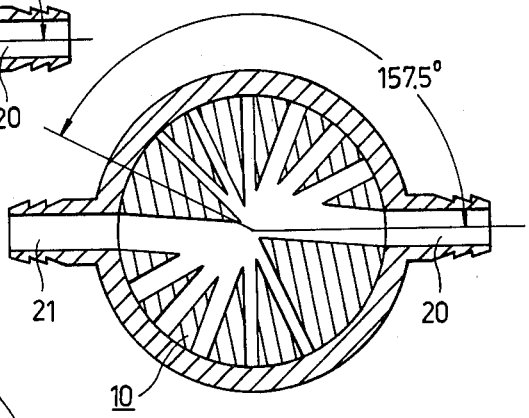
Figure 2L:
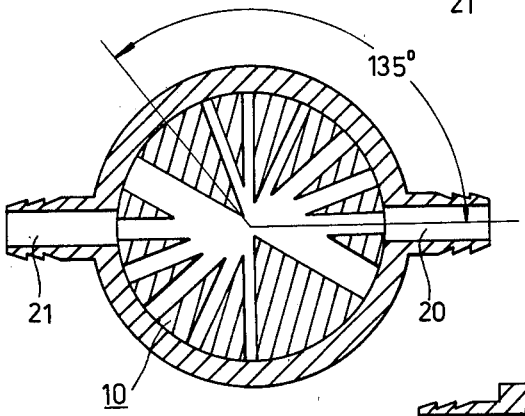
Figure 2N:
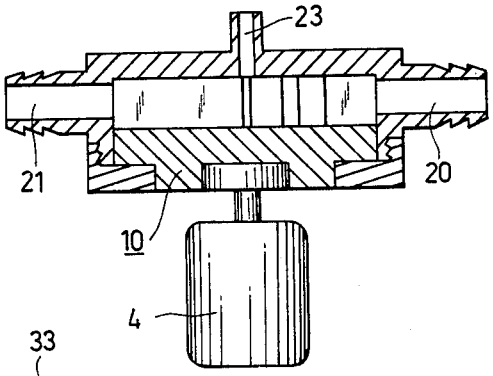

FIG. 2*a* is a sectional top view of the valve of the present invention. FIG. 2*b* is sectional front view of the valve of the present invention. FIG. 2*c* is a sectional oblique view of the valve of the present invention. A plurality of gas channels are provided withn the rotor (10) of the valve (in this embodiment, there are seven gas channels and a blocked channel). The channels are divided from each other by triangular portions of rotor (10) each having an angle of 22.5 degrees. All the channels, however, communicate with one another at the center (10) of the rotor (10). The gas channels themselves have different measurements. When the angle of the rotor (10) is zero degrees (i.e. when the input voltage of the servo-motor is zero volts and therefore, the power supply is off), the gas inlet (20) and the gas outlet (21) of the valve are blocked by the block channel (12) of the rotor (10) thereby completely cutting off the gas path. When the rotor (10) is driven by the servo-motor (4) to rotate in a counterclockwise direction to an angle of 22.5 degrees, the base fire gas channel (13) is brought into communication with the gas inlet (20). Gas outlet (21) will still be blocked by the portion (22) of the rotor (10) which is opposite to the base fire gas channel (13). Therefore, the gas flow can only escape through outlet (23) located on the center (11) of the rotor via base fire gas channel (13). Outlet (23) is connected to the base fire nozzle beside the ignition head by means of base fire gas port (23). Base fire gas port (23) has the same diameter measurement as the width measurement of base fire gas channel (13). When the rotor (10) is rotated to a 45 degree angle, both ends of gas channel (14,14) (for a very mild fire) are in communication with gas inlet (20) and gas outlet (21) respectively. A portion of the gas flow is then directed to the burner from the gas outlet (21) while a portion of the gas continuously flows to the base fire nozzle through the metal tube (23) which is situated at the center (11) of the rotor for maintaining the base fire. If key S2 for the very mild fire is pressed down, the electronic ignition circuit will begin its ignition operation until the gas fed to the base fire nozzle through the metal tube (23) has been ignited. The gas flowing to the burner through gas channel (14) will then be ignited by the base fire and will produce a low flame for a very mild temperature. This flame will correspond to the size of gas channel (14). The rotor (10) can be rotated to a 67.5 degree angle for a mild fire, a 90 degree angle for a moderate fire, a 112.5 degree angle for a strong fire, a 135 degree angle for a hot fire, or a 157.5 degree angle for a very hot fire. FIGS. 2*d*–2*n* illustrate various positions of the rotor channels as they communicate with gas inlet (20) and gas outlet (21). It is believed that the operation of rotor (10) within the valve may be readily understood from these drawings. The valve of the present invention may be sealed by known industrial techniques. Such techniques are used in valves carrying fluids under high pressures. Such sealing techniques would be appropriate in the present instance for a valve carrying gas fluids under low pressure.

Figure 3:
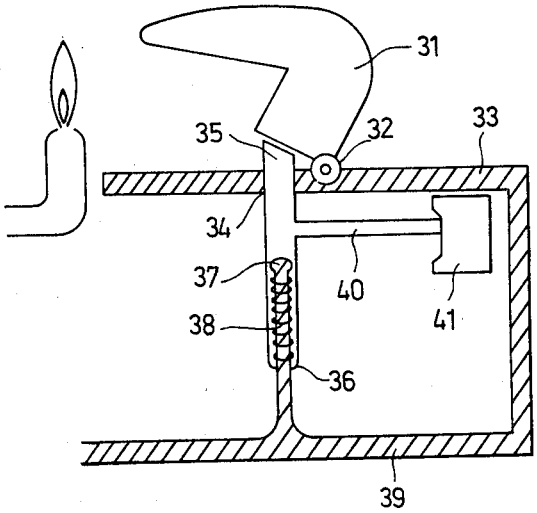
FIG. 3 is a sectional view of the double pole single throw switch S8 in accordance with the present invention.

FIG. 3 is a sectional view of the double pole single throw switch S8 of the present invention. A grate (31) is journaled at a pivot (32) to chassis (33). Chassis (33) supports other grates. A hollow metal tube (34) is mounted under pivot (32) and extends through hole (35) in chassis (33) to the bottom of grate (31). Metal tube (34) bends slightly inwardly at its lower end to form opening (36). Opening (36) is of a smaller diameter than that of tube (34). A tube support (37) with a head is positioned within metal tube (34) and is partially surrounded by spring (38). Metal tube (34) is fixed to bottom-plate (39) of the gas range. Spring (38) is positioned within and is secured at one end to head (37) and at a second end to bent opening (36). Thus grate (31) is biased upwardly through the tensioning of spring (38). The tension force of spring (38) need not be great. It is sufficient if it has enough force to raise grate (31) when it is not being depressed by a pot or other surface article. Grate (31) weighs about 10–20 grams which is less than the weight of a very small pot (about 0.5 kilograms). In addition, link (40) made of a rigid and heat insulating material (such as asbestos or ceramic) is oriented toward a corner location of the burner and therefore, will not be easily contaminated. Link (40) is connected to metal tube (34) under chassis (33). Link (40) extends into switch box (41) connecting with double pole single throw switch S8. The location of link (40) varies in correspondence with the presence of a pot on grate (31). Thus switch S8 is operated through the action of link (40) and thereby controls the flame intensity upon placement on or removal from grate (31) of a pot. The mechanism for the present invention is therefore simple to construct, inexpensive, and energy efficient.

In conclusion, the present invention discloses a key (touch switch) controlled gas range which can produce a plurality of flame intensities by operating a simple selection control mechanism. There is no need to bring the gas flow of the present range to its greatest intensity to light a flame and then to readjust it to a desired level. Nor is there a need to judge the level of intensity of the flame by means of sight and therefore, by means of bending one's body to a position to see the flame. A pressure switch is provided at the center of the present gas range thereby enabling the flame to be automatically changed from a base fire when no pot is on the range, to the flame originally chosen when a pot is put on the range. The switch box (S0–S9) of this invention may be mounted at a place adjacent to the working position (such as a working counter or table), thereby significantly increasing the convenience and energy saving aspects of the present invention.

It should be understood that the embodiment described herein may be modified as would occur to one with ordinary skill in the art without departing from the scope of the present invention.

What is claimed is:

1. A controlled gas range comprising:

means for adjusting the flame intensity in a controlled manner;

a continuous electronic ignition circuit;

a valve; and a burner, characterized in that said valve includes a rotor defining a plurality of channels therein, a housing and a servo-motor connected to said rotor, a gas inlet and a gas outlet said gas outlet having a diameter slightly greater or equal to that of the largest channel within the rotor, said gas inlet and said gas outlet being respectively provided on said housing in an opposing relationship to each other, said gas inlet further being connected to a gas source and said gas outlet further being directed to the burner;

said housing further including an upper face defining a small orifice with a diameter sufficient to supply the amount of gas for a base fire, said orofice being connected to and adjacent to said electronic ignition circuit of said burner by a tube;

said plurality of channels including communicating channels and at least one blocked channel at symmetrical positions in said rotor, the size of said communicating channels being different for each symmetrical position, said communicating channels communicating with the center of said rotor so that there are channels with different sizes connected between said gas inlet and outlet under different rotating angles of said rotor thereby directing various amounts of gas to said burner, said gas inlet and said outlet both being blocked by said rotor when said rotor is rotated with an angle for said blocked channel to cut off the gas supply, said channels including one base fire channel which is blocked at one end so that the base fire channel is only connected between said gas inlet and said orifice when said rotor is rotated with an angle for said base fire channel.

2. A gas range as claimed in claim 1, wherein said control means includes several keys;

an operational amplifier;

and a servo-motor;

and wherein said electronic ignition includes a power switch;

characterized in that said operational amplifier is connected in parallel with a plurality of resistors which are in series with said keys respectively, said keys are respectively linked with a general power switch and the power switch of said electronic ignition circuit in the manner of a three pole switch so that the pressing of one of said keys will switch on the general power switch and said power switch of said ignition circuit and will connect the respective resistor to said operational amplifier to produce a voltage corresponding to said connected resistor to drive said servo-motor to rotate to a desired angle.

3. A gas range as claimed in claim 2, further including a double pole single throw switch which is operated by a grate through a linkage, one of the two poles of the said double pole switch being normally open and the other pole being normally closed;

said normally opened pole being connected between the output of said operational amplifier and the input of said servo-motor;

said normally closed pole being connected between the power supply of said ignition circuit and the output of said servo-motor so that said servo-motor may be directed in a constant voltage or several detemined key-controlled voltages dependent upon the position of said double pole switch.

* * * * *